US005551936A

United States Patent [19]

Parisi et al.

[11] Patent Number: 5,551,936

[45] Date of Patent: Sep. 3, 1996

[54] COLLAPSIBLE WEIGHT LIFTER'S BENCH

[76] Inventors: Richard H. Parisi, 51 Glenroy Rd. South, Fairfield, N.J. 07004; Patrick J. Murphy, 248 2nd Ave., Garwood, N.J. 07027

[21] Appl. No.: 543,855

[22] Filed: Oct. 12, 1995

[51] Int. Cl.[6] ..... A63B 21/00

[52] U.S. Cl. ..... 482/142; 482/104; 482/908; 108/131

[58] Field of Search ..... 482/104, 142, 482/148, 908; 108/115, 127, 131, 132; 5/178

[56] References Cited

U.S. PATENT DOCUMENTS

| | | | |
|---|---|---|---|
| 819,969 | 5/1906 | Anderson | 108/131 |
| 3,342,485 | 9/1967 | Gaul | 482/104 |
| 3,948,513 | 4/1976 | Pfotenhauer . | |
| 4,645,196 | 2/1987 | Christie . | |
| 4,960,277 | 10/1990 | LaRossa et al. . | |
| 5,076,579 | 12/1991 | Rickey | 482/142 |
| 5,082,259 | 1/1992 | Gonzalez | 482/104 |
| 5,256,126 | 10/1993 | Grostein | 482/142 |

FOREIGN PATENT DOCUMENTS

| | | | |
|---|---|---|---|
| 216701 | 8/1961 | Austria | 108/131 |
| 2627090 | 8/1989 | France | 482/142 |
| 2065482 | 7/1981 | United Kingdom | 482/104 |
| 2236685 | 4/1991 | United Kingdom | 482/104 |

*Primary Examiner*—Richard J. Apley
*Assistant Examiner*—Victor K. Hwang
*Attorney, Agent, or Firm*—William Squire

[57] ABSTRACT

A pad frame is formed of angle irons to which one section of an articulating dual section pad is secured. A head end frame comprising a pair of pipe uprights secured by an angle iron cross base member and a pipe intermediate member is secured to the pad frame by releasable locking pins in the upright position and foldable to a storage condition by removing the pins. A foot end frame comprises a U-shaped member and an angle iron cross base member rotatably secured to the pad frame and secured upright by releasable locking pins. The collapsed head end and foot end frames are rotated parallel to the pad frame and secured to the pad frame by fasteners. A removable brace is releasably secured to and between the head and foot cross base members in the unfolded bench use condition.

19 Claims, 3 Drawing Sheets

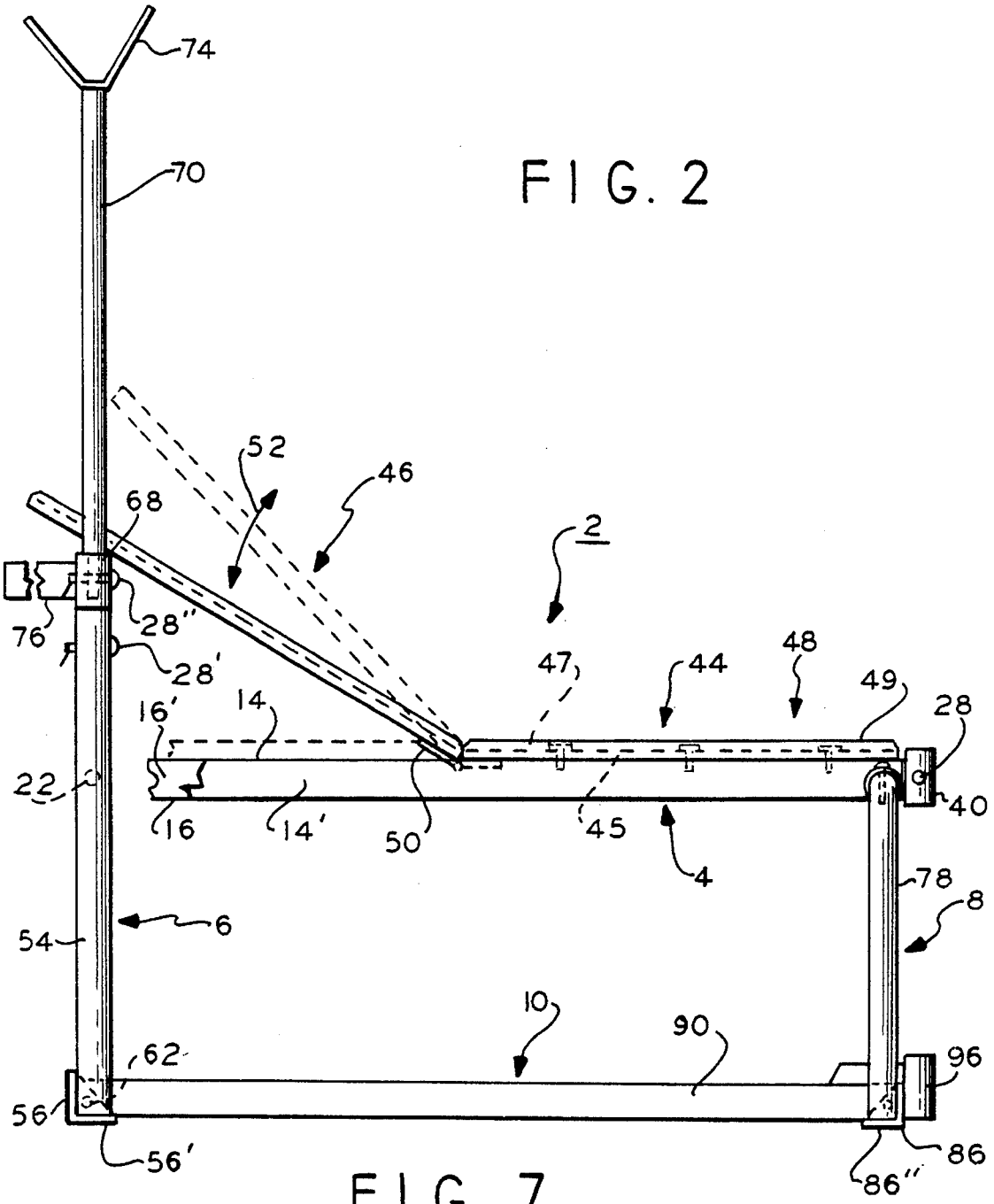
FIG. 2
FIG. 7
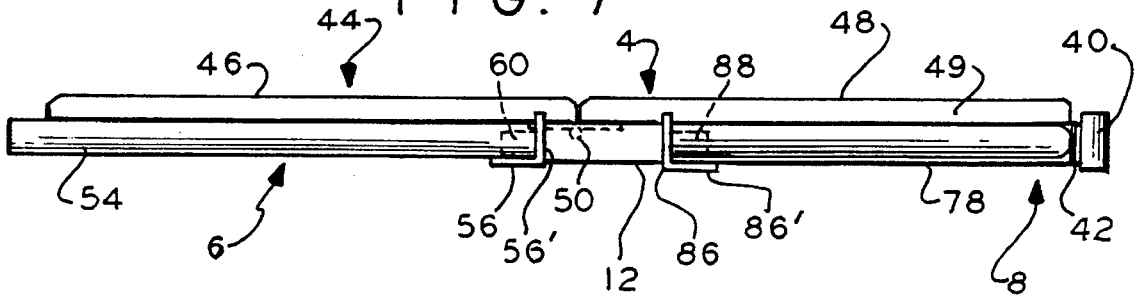

COLLAPSIBLE WEIGHT LIFTER'S BENCH

This invention relates to portable foldable weight lifting benches or compact storage.

Comfortable, foldable weight lifter's benches are known. For example, such a bench is disclosed in U.S. Pat. No. 4,960,277. This bench comprises a foldable frame and a bench pad supported on the frame. One problem with this bench is that when laid on a supporting floor in the folded condition, the folded legs are not parallel to the pad frame causing the structure to be somewhat unstable. This takes up storage room and also, would be unstable if one were to accidentally step onto the folded frame, causing a person to possibly fall. Such an accident might occur because the bench is folded for storage under a bed.

More importantly, the foldable legs are supported to the pad frame by angled braces which are foldable. These type of braces are generally weak and tend to result in play during use. Because weights lifted during use of the bench may be several hundred pounds, the present inventors believe these braces have insufficient long term stability and strength for use with such weights. They believe that the braces disclosed could not reliably support such weights and, therefore, this construction limits the utility of the bench to relatively small weights.

U.S. Pat. No. 4,645,196 discloses a further folding weight bench and U.S. Pat. No. 3,948,513 discloses an exercising apparatus.

The present inventors recognize a need for a collapsible weight lifter's bench which is compact when stored, stores in a stable flat mode to minimize accidents should a person step on the folded bench and is sufficiently stable to support lifting weights of up to about at least five hundred pounds.

A collapsible weight lifter's bench according to the present invention comprises a pad support frame having a head end and a foot end; a pad supported on and secured to the frame; and a head end frame for supporting the pad frame at the head end and comprising a pair of spaced elongated upright members; an elongated first cross base member secured to an end of each the upright members for supporting the upright members; and an elongated intermediate member secured at its respective ends to and medially each the upright members and rotatably secured to the pad support frame.

The bench further comprises first means including first pin means for selectively fixedly locking the pad support frame at the pad support frame head end to the intermediate member; a foot end frame for supporting the pad frame at the foot end comprising a U-shaped support member including a pair of upright legs and a pad frame support bar fixedly connected to and between an end of each the upright legs. The pad support bar is rotatably secured to the pad support frame. Second means are included including second pin means for fixedly locking the pad support frame at the pad support frame foot end to the support bar. An elongated second cross base member is secured to an end of each the legs distal the bar for supporting the legs. An elongated brace member is releasably secured to and between the head end frame medially the elongated first cross base member and the foot end frame medially the second cross base member.

According to one embodiment, the bench includes third pin means for releasably securing the brace member to the first and second cross base members.

According to a further embodiment, the bench further includes first and second elongated extension members adjustably secured to a different corresponding one of said pair of upright members, a further cross member adjustably secured to said extension members, and fourth pin means for releasably adjusting the position of said further cross member to said extension members and said extension members to said upright members.

According to a still further embodiment, the uprights and upright legs are arranged so that they rotate from a first pad frame support position to a second folded position, the uprights and upright legs in the folded condition lying parallel to each other and the pad frame so as to lay substantially flat on a support.

IN THE DRAWING

FIG. 2 is a side elevation view of the bench of FIG. 1;

FIG. 7 is a side elevation view of the bench of FIG. 1 in the folded collapsed condition.

Figure 1:
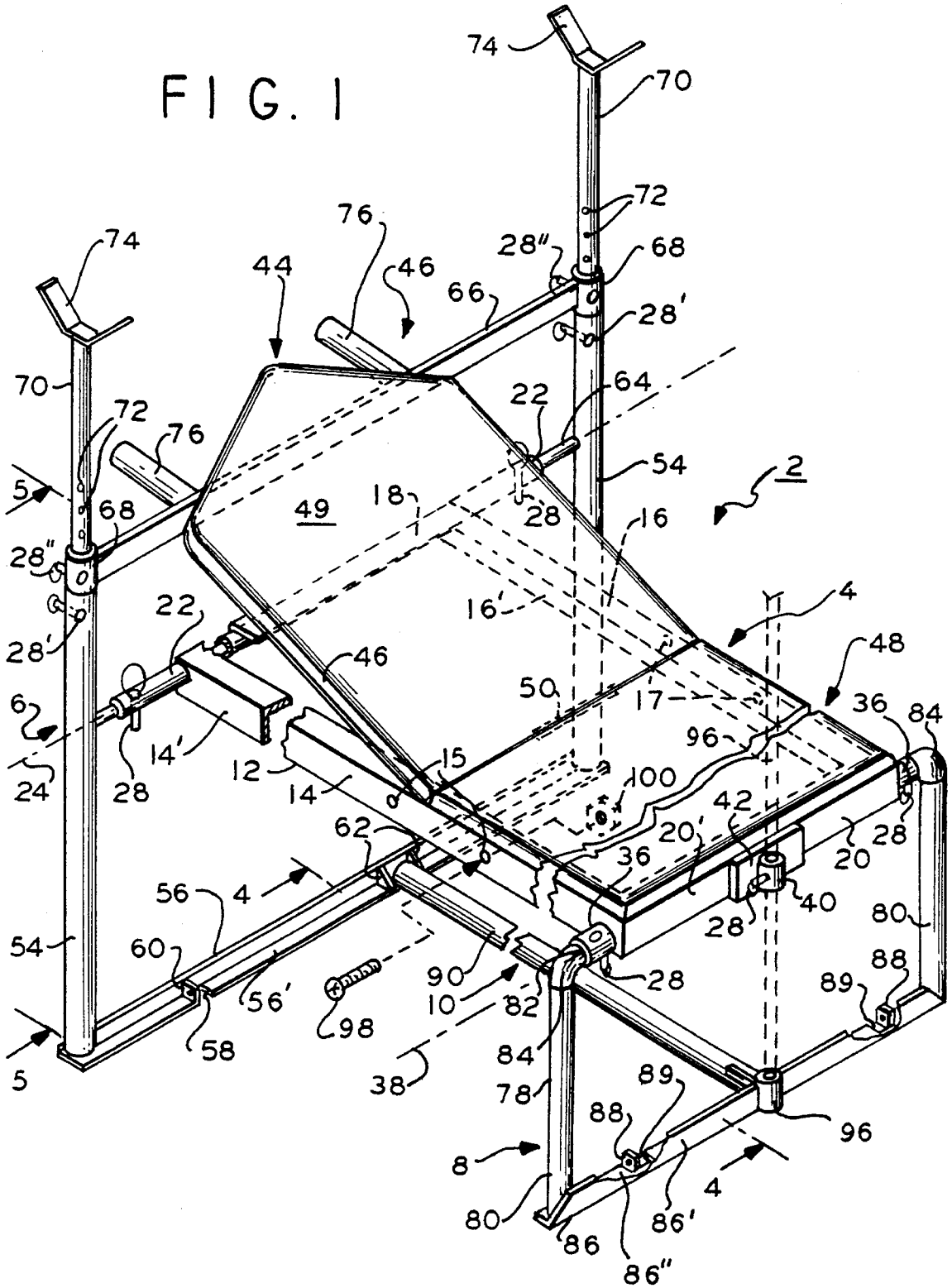
FIG. 1 is an isometric view of a bench according to an embodiment of the present invention.

In FIG. 1, bench 2 comprises a pad and pad frame assembly 4, a head end frame 6, a foot end frame 8 and a brace 10. Pad frame assembly 4 comprises a rectangular frame 12 formed of four angle irons 14, 16, 18 and 20 welded end to end to each other. The angle irons may be, for example, 2×2×⅛ inch. A preferably metal hollow core pipe collar 22 is aligned with angle iron 18 on axis 24. Collar 22 passes through and is welded to legs 14', 16' of respective irons 14 and 16. Two pairs of aligned apertures are in collar 22 spaced from legs 14' and 16' each pair for releasably receiving a corresponding locking pin 28. The leg 14' has a pair of like spaced apertures 15 and the leg 16' has a pair of similar apertures 17 medially the legs.

Figure 6:
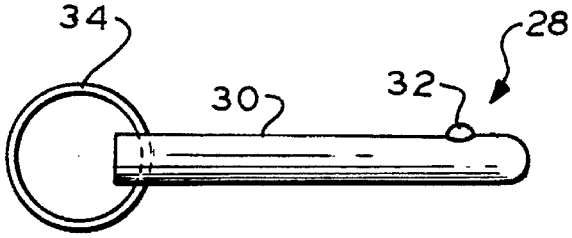
FIG. 6 is a side elevation view of a locking pin employed in the embodiment of FIG. 1.

Locking pins 28 are identical throughout the bench 2 and typically comprise, FIG. 6, a metal shaft 30, a resiliently secured locking ball 32 and a ring 34. Not shown is a spring for resiliently loading the ball 32 in a known manner. The pin 28 is commercially available and can support a shear load of about 4300 pounds.

In FIG. 1, a hollow core preferably metal pipe collar 36 passes through legs 14' and 16' and is preferably welded to opposite sides of the frame assembly 4 at legs 14' and 16' aligned on axis 38. A collar 40 is welded to a plate 42 which in turn is welded to leg 20' of iron 20. Collar 40 is normal to axis 38. The collars 36 and 40 each have a pair of aligned apertures for receiving a pin 28 shaft 30 therethrough.

Frame assembly 4 includes a pad assembly 44. Assembly 44 includes two sections 46 and 48 hinged by hinge 50. Each section comprises a rigid base 45, e.g., ¾ inch plywood, and a cushion 47 comprising foam padding, e.g., ¾ inch thick foam, covered with a vinyl cover 49. The plywood base 45 of section 48 is screwed for example to the irons 14 and 16 while section 46 can articulate relative to section 48 as shown in phantom in FIG. 2, directions 52. Section 46 may rest horizontally on the frame irons 14, 16, 18 and 20.

Head end frame 6 comprises a pair of uprights 54 preferably metal 1.66 OD and 0.140 wall thickness hollow core pipes. The uprights 54 are preferably welded to a lower cross base member 56 preferably formed of 2×2×¼ inch angle iron. The uprights are attached to the interior facing surfaces of the legs of the base member 56 so that one leg 56' lays flat on a floor when the bench is in use. Leg 56' has a pair of slots 58 (one being shown) and an upright apertured lug 60. The lug 60 aligns with an aperture 15 on frame leg 14' to secure the frame 6 in the folded condition. A second lug (not shown) is secured to leg 16' aperture 17 similarly. The slots 58 permit the uprights 54 to be folded flat against and parallel to the frame 4 by receiving the legs 14' and 16'. A pair of triangular metal supports 62 are welded to the base member 56 in spaced relation. Holes (not shown) are in the supports 62 for receiving a pin 28 shaft 30.

An intermediate cross member 64 is welded to and between the uprights 54 medially the uprights. The cross member is a pipe that fits within the core of collar 22 so that collar 22 and thus frame assembly 4 can rotate about the member 64 on axis 24. Pins 28 passing through the collar 22 and member 64 lock the frame assembly 4 in fixed relation to the member 64 and uprights 54.

A second cross member 66 comprising a rectangular in section metal bar has its ends welded to collars 68. A pipe extension 70 is slidably received in the core of each upright 54. An array of apertures 72 is in each extension for adjusting the height of the extension relative to the member 66. A locking pin 28' identical to pins 28 is used to adjust the extension length above the uprights 54 via apertures 72. A second identical locking pin 28" is used to set the position of the cross member 66 above and relative to the cross member 64 using the apertures 72. The pins 28" pass through a collar 68 and the corresponding extension 70. A bar bell support 74 is secured to the upper end of each extension 70. Other accessories and corresponding extensions may be used in place of the extensions 70 to secure other types of equipment to the bench 2. A pair of handle grips 76 extend from the cross member 66 to be gripped by a person during use of the bench 2.

The foot end frame 8 comprises a U-shaped member 78 having a pair of upright legs 80 and a pad frame support bar 82 connected by an elbow 84 welded thereto. A base member 86 preferably comprising an angle iron of the same material as member 56 is preferably welded to the lowermost ends of the legs 80 in similar fashion as uprights 54 are secured to member 56. The ends of one of the legs 86' of base member 86 is chamfered at each end. A pair of lugs 88 are secured to leg 86" of member 86. A slot 89 is formed in leg 86" adjacent to each of the lugs 88. A pair of spaced apertured triangular supports 92 are secured, e.g., welded, medially to the legs of the base member 86.

The frame support bar 82 passes through the core of collar 36 and is rotatable about axis 38. A pair of locking pins 28 are releasably secured to and pass through each of the collar 36 and bar 82 on opposite sides of the assembly 4 to selectively fix the frame 8 relative to the pad frame assembly 4. When the pins 28 are removed the frame 8 can rotate about axis 38.

Figure 3:
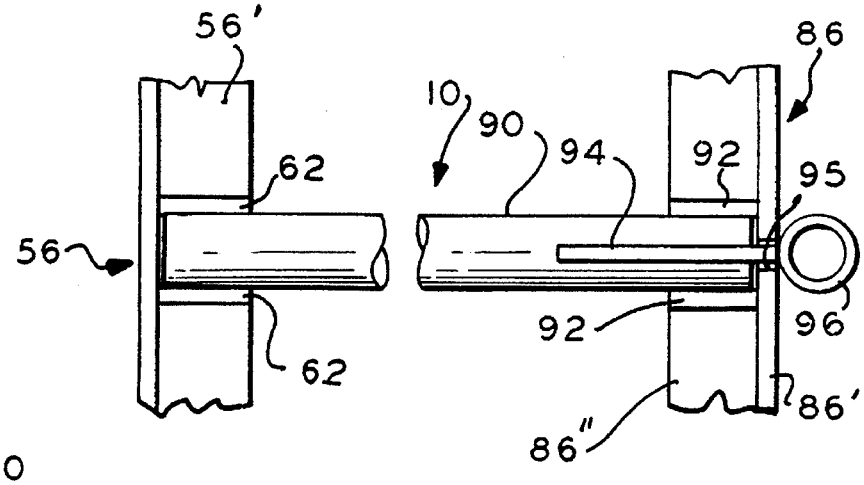
FIG. 3 is a plan fragmented view of the brace portion of the bench of FIG. 1.
Figure 5:
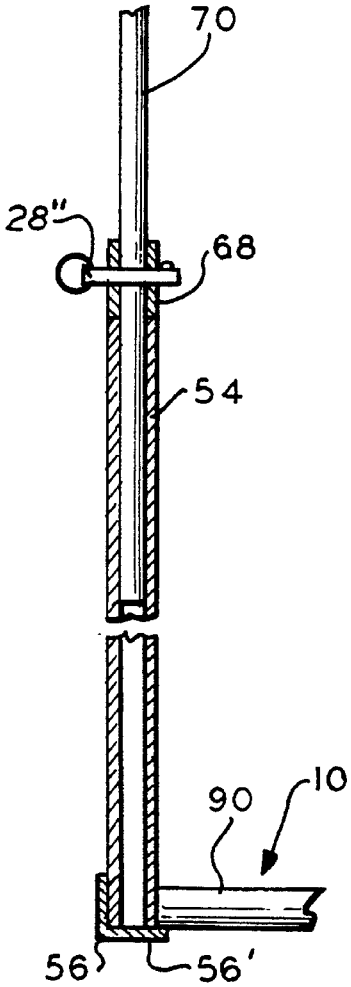
FIG. 5 is a fragmented sectional view taken along lines 5—5 of FIG. 1.
Figure 4:
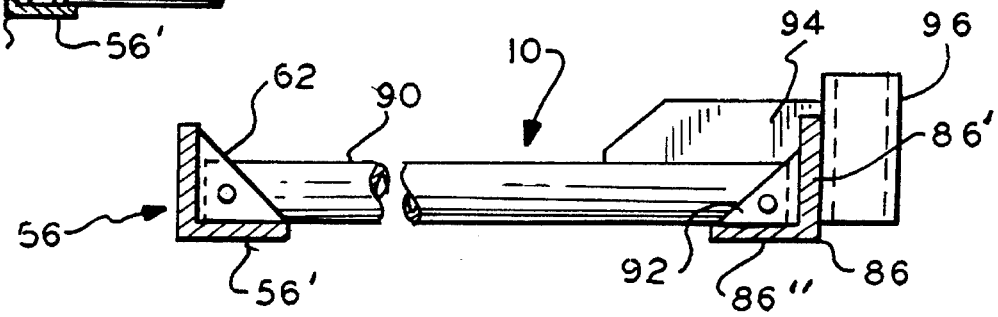
FIG. 4 is a side elevation view of the fragmented brace portion of FIG. 3 taken along lines 4—4 of FIG. 1.

Brace 10, FIGS. 3 and 4, preferably comprises a metal pipe 90 one end of which fits into the space between supports 62 on the head end base member 56 and releasably held in place by a locking pin 28 passing through supports 62 and pipe 90 (not shown).

The other end of the brace 10 is welded to a plate 94 which fits in a slot 95 in the pipe 90. The plate 94 releasably fits in a slot in leg 86' of member 86 so that pipe 90 is parallel to the pad frame 4. The pipe 90 also fits in the space formed by supports 92 and has an aperture therein for receiving a locking pin 28 (not shown). A locking pin 28 is releasably secured to the supports 92 and pipe 90 via their apertures. The pins 28 thus releasably secure the brace 10 to the head end and foot end base members 56 and 86, respectively. The brace 10 thus substantially stiffens the head end and foot end frames 6 and 8, respectively, relative to the pad frame assembly 4.

A hollow core pipe collar 96 is welded to an edge of the plate 94 and aligned with the collar 40 to receive an accessory support pipe 96.

In operation, in the folded state of FIG. 7, the lugs 60 (FIG. 1) and 88 are bolted to the legs 14' and 16' of respective irons 14 and 16 of the pad frame assembly 4 using screws 98 and nuts 100. In this folded collapsed condition, the head end frame 6 and the foot end frame 8 are substantially parallel to the pad and frame assembly 4. This is because the slots 58 in member 56 and 89 in member 86 receive the legs 14' and 16' while permitting the lugs 60 and 88 to be fastened to these legs. The angle irons 56 and 86 each have legs which lay flat on the floor and which permit the frames 6 and 8 to also substantially lie flat on the floor notwithstanding the thickness of the legs of the angle irons 56 and 86, which are relatively small in comparison to the other dimensions. This provides a relatively compact assembly.

To assemble the bench 2, the screws 98 and nuts 100 are removed and the frames 6 and 8 rotated to the position of FIGS. 1 and 2. At this time the brace 10 is assembled by fastening one end with a locking pin 28 to member 56 supports 62 and the other end with a second locking pin 28 to supports 92, FIG. 3. Further locking pins 28 are attached to collar 22 and cross member 64 to preclude collapsing of the frame 6. Locking pins 28 also secure the collar 36 to the support bar 82 to preclude collapsing of the frame 8. The extensions 70 and cross member 66 are then attached by further locking pins to the uprights 54. Further accessories may be attached to pipe 96 secured to collars 40 and 96 by additional locking pins 28. The extensions 70 may be replaced by other extensions to secure other accessories as desired.

The legs 86" and 56' of the base cross members 86 and 56, respectively, lie flat on a floor providing enhanced stability. Also this increases friction with the floor as compared to pipes providing a flat larger surface area against the floor to provide additional resistance to sliding about the floor by the bench 2 during use. By providing suitably dimensioned angle irons and pipes as described herein, e.g., 1.315 OD and 0.133 inch wall thickness metal pipes for legs 78 and 80 and bar 82, 1.66 OD and 0.140 inch wall thickness for uprights 54, 1.315 OD metal pipes for extensions 70, 2×2×⅛ angle irons for the bench pad frame and 2×2×¼ inch metal flat stock for member 66, the bench 2 can support a load of about 2000 pounds with good stability and yet is easily collapsed when desired. To collapse the bench the locking pins 28 are readily removed and the frames 6 and 8 folded to the position of FIG. 7 and locked in place with screws 98 and nuts 100.

It will occur to one of ordinary skill that various modifications may be made within the scope of the invention according to the appended claims.

What is claimed is:

1. Collapsible weight lifter's bench comprising:

a pad support frame having a head end and a foot end;

a pad supported on and secured to the pad support frame;

a head end frame rotatably secured to and for supporting said pad support frame at said head end comprising:

a pair of spaced elongated upright member;

an elongated first cross base member secured to an end of each said upright members for supporting said upright member; and an elongated intermediate member secured at its respective ends to and medially each said upright members and rotatably secured to the pad support frame;

first means including first pin means for selectively fixedly locking the pad support frame at said pad support frame head end to said intermediate member to preclude relative rotation of the intermediate member to the pad support frame;

a foot end frame for supporting said pad frame at said foot end comprising;

a U-shaped support member including a pair of upright legs and a pad frame support bar fixedly connected to and between an end of each said upright legs, said bar being rotatably secured to said pad support frame;

second means including second pin means for selectively fixedly locking the pad support frame at said pad support frame foot end to said support bar to preclude relative rotation of the bar to the pad support frame; and an elongated second cross base member secured to an end of each said legs distal said bar for supporting said legs; and an elongated brace member releasably secured to and between the head end frame medially the elongated first cross base member and the foot end frame medially the second cross base member.

2. The bench of claim 1 wherein said pad comprises first and second sections supported on the pad support frame, the first pad section forming a head end hinged to the second section forming a foot end, the pad overlying the pad support frame with the head and foot ends at the respective frame head and foot ends and means for securing the second foot end section to said frame so the first head end section articulates relative to the second foot end section.

3. The bench of claim 1 wherein said first and second pin means are arranged to be releasably secured to said pad support frame at said head end and to said intermediate member and to said pad support frame at said foot end and to said bar, respectively.

4. The bench of claim 1 including third pin means for releasably securing said brace member to said first and second cross base members.

5. The bench of claim 1 further including first and second elongated extension members adjustably secured to a different corresponding one of said pair of upright members, a further cross member adjustably secured to said extension members, and fourth pin means for releasably adjusting the position of said further cross member to said extension members and said extension members to said upright members.

6. The bench of claim 5 further including a pair of gripping means extending from said further cross member.

7. The bench of claim 5 wherein said pad comprises first and second sections and is supported on the pad support frame, the first pad section forming a head end hinged to the second section, the second section forming a foot end, the pad overlying the pad support frame with the head and foot ends at the respective frame head and foot ends and means for securing the second foot end section to said frame so the first head end section articulates relative to the foot end, said pad sections each comprising a rigid portion supporting a cushioned portion, said first pad section for selective positioning on said intermediate member and said further cross member.

8. The bench of claim 1 wherein said first and second pin means each comprises a shaft with a head member at one end of the shaft and resilient shaft securing means secured to the shaft at the shaft other end, said intermediate member and support bar each having an aperture for receiving a shaft and shaft securing means therethrough.

9. The bench of claim 1 wherein said pair of upright and upright legs each comprise a pipe welded respectively to said first and second cross base members, said first and second cross base members each comprising an angle iron having planar first and second legs, one of said first and second legs being normal to the respective upright or upright member leg secured thereto and the other of said first and second legs being parallel to the respective upright or upright leg secured thereto.

10. The bench of claim 9 wherein the elongated brace member is a pipe having a brace aperture therethrough at opposing ends, said first and second cross base members including apertured securing means for alignment with and corresponding to a different one of said brace apertures and third pin means for securing the brace member to said cross base members via a brace aperture and apertured securing means.

11. The bench of claim 1 wherein said upright and upright legs are arranged so that they rotate from a first pad frame support position to a second folded position, said upright and upright legs in the folded position lying parallel to each other and the pad frame so as to lay substantially flat on a support.

12. The bench of claim 11 including frame securing means for securing the head end frame and the foot end frame to the pad support frame in the second folded position.

13. The bench of claim 12 wherein the frame securing means comprises a pair of first lugs on the first cross base member and a pair of second lugs on the second cross base member and a plurality of apertures on said pad support frame each for respective alignment with a corresponding different one of said lugs and further securing means for releasably securing the lugs to a corresponding aligned aperture.

14. The bench of claim 1 wherein said pad support frame an elongated brace member at said foot end includes receptacle means for receiving a further upright for securing accessories to said bench.

15. The bench of claim 1 wherein said pad support frame comprises a rectangular frame formed of angle irons.

16. The bench of claim 1 including a first pair of cylindrical collars extending from said pad support frame in opposing directions at said head end and a second pair of cylindrical collars extending in opposing directions from said pad support frame at said foot end, said intermediate member comprising a cylindrical pipe rotatably received in said first pair of collars and said support bar comprising a cylindrical pipe rotatably received in said second pair of collars.

17. The bench of claim 1 wherein said elongated brace comprises a pipe and said first cross base member includes means forming a receptacle for an end of the elongated brace, said elongated brace other end including a plate member secured thereto, said second cross base member having a slot for releasably receiving the plate member.

18. The bench of claim 17 including a pipe section secured to said plate member such that the second cross base member is sandwiched between the elongated brace member and said pipe section.

19. Collapsible weight lifter's bench comprising:

a pad support frame having a head end and a foot end;

an articulating pad having a cushion portion and a rigid portion, said pad being supported on and secured to the pad support frame;

a head end frame for supporting said pad frame at said head end comprising:

a pair of spaced elongated upright members;

an elongated first cross base member secured to an end of each said upright member for supporting said upright members;

an elongated intermediate member secured at its respective ends to and medially each said upright member and rotatably secured to the pad support frame;

an elongated further cross member for selectively supporting said pad at said head end;

a pair of further uprights each adjustably secured to a different one of said pair of upright members; and means for releasably securing the elongated further cross member to the further uprights and the further uprights to the pair of upright members;

first means including first pin means for selectively fixedly locking the pad support frame at said pad support frame head end to said intermediate member;

a foot end frame for supporting said pad frame at said foot end comprising;

a U-shaped support member including a pair of upright legs and a pad frame support bar fixedly connected to and between end of each said upright legs, said support bar being rotatably secured to the pad support frame;

second means including second pin means for selectively fixedly locking the pad support frame at said pad support frame foot end to said support bar to preclude relative rotation between the support bar and pad support frame; and an elongated second cross base member secured to an end of each said upright legs distal said support bar for supporting said upright legs;

an elongated brace member releasably secured to and between the head end frame medially the elongated first cross base member and the foot end frame medially the second cross base member; and third pin means including resilient detent means for releasably securing the brace member to said first and second cross base members.

* * * * *

UNITED STATES PATENT AND TRADEMARK OFFICE

CERTIFICATE OF CORRECTION

PATENT NO. : 5,551,936

DATED : September 3, 1996

INVENTOR(S) : Richard H. Parisi, et. al.

It is certified that error appears in the above-indentified patent and that said Letters Patent is hereby corrected as shown below:

Column 4, line 66, change "members" to -- member --.

Column 5, line 4, change "members" to -- member --.

Column 6, line 5, after "upright" insert -- members --.

Column 6, lines 10 and 12, after "upright" insert -- member -- (two places).

Column 6, line 11, delete "member".

Column 6, lines 22 and 23, after "upright" insert -- members -- (two places).

Signed and Sealed this

Seventeenth Day of December, 1996

*Attest:*

Bruce Lehman

BRUCE LEHMAN

*Attesting Officer*

*Commissioner of Patents and Trademarks*